United States Patent [19]

Klug et al.

[11] Patent Number: 4,555,900

[45] Date of Patent: Dec. 3, 1985

[54] BALLOONING ACTION CONSTRAINING RING

[75] Inventors: Lothar Klug, Elsenfeld; Klaus Schmuck, Erlenbach, both of Fed. Rep. of Germany

[73] Assignee: Akzo N.V., Arnhem, Netherlands

[21] Appl. No.: 566,819

[22] Filed: Dec. 28, 1983

[30] Foreign Application Priority Data

Dec. 28, 1982 [DE] Fed. Rep. of Germany ..... 3248238
Nov. 17, 1983 [DE] Fed. Rep. of Germany ..... 3341489

[51] Int. Cl.[4] ..... D01H 1/42; D01H 7/18
[52] U.S. Cl. ..... 57/355
[58] Field of Search ..... 57/354, 355, 357, 120

[56] References Cited

U.S. PATENT DOCUMENTS

| | | | |
|---|---|---|---|
| 3,316,703 | 5/1967 | McKelvie | 57/354 |
| 3,638,415 | 2/1972 | Andrews | 57/355 |
| 3,979,895 | 9/1976 | Ehrler et al. | 57/352 |
| 4,397,143 | 8/1983 | Klein | 57/355 |
| 4,423,590 | 1/1984 | Tsukamota et al. | 57/357 X |

FOREIGN PATENT DOCUMENTS

| | | |
|---|---|---|
| 2351974 | 10/1973 | Fed. Rep. of Germany . |
| 8212094.3 | 4/1982 | Fed. Rep. of Germany . |

OTHER PUBLICATIONS

Mellinand Textilberichte, 4/1979, pp. 297/298.
Chemiefasern/Textilindustrie, Aug. 1975, pp. 668–673.

*Primary Examiner*—Donald Watkins
*Attorney, Agent, or Firm*—Michael J. Striker

[57] ABSTRACT

A ballooning action constraining ring is disclosed, with which at least the surface coming into contact with the thread is composed of a raw material that absorbs at least 15% by volume of lubricant, whereby the absorption of lubricant is concluded at the earliest after 15 minutes. The amount of lubricant absorbed after the 15 minutes should amount to at most 25 volume-%. The average hydrodynamic pore diameter of this raw material is between 5 and 25 μm. A preferred raw material is wood. The constraining ring can display a thread slit, an oil groove or a lubricant canal and can be composed of several superposed individual rings or be formed from pliable wood or shaped into a helix.

17 Claims, 19 Drawing Figures

BALLOONING ACTION CONSTRAINING RING

BACKGROUND OF THE INVENTION

The invention concerns a ballooning action constraining ring made of a material which is suitable for absorbing lubricant, the thread contact surface of which ring is such that the friction stress on the threads is decreased by means of the thread contact surface.

The problem which occurs upon the working up of fibers, particularly with the working up of synthetic fibers, specifically polyester fibers, on ring spinning machines, is known from Melliand Textilberichte, 1979, pp. 297/298. With use of the previously customary ballooning action constraining rings, losses in tensile strength and elongation occur in the yarn, which amount to about 30–50% of the tensile strength and elongation, which are obtained when the same yarn is produced with a working-up speed about 15–20% smaller. Moreover, there is found therewith, in customary manner, a strong roughening of the yarn with fiber injury, which leads upon its further working up to a strong fiber fraying. With the use of the previously customary ballooning action constraining rings there occurs in other respects tensile strength and elongation differences in the prepared yarn between the thread sections developed in the upper region (cop tips) and in the lower region (cop base) of the cop, which leads to differences in dye affinity, and which, particularly with colored knitwear, has a disturbing effect by means of the thereby effected curl formation. In order to obtain an increase in production without injury to the yarn, for decreasing the friction stress of the thread at the ballooning action constraining ring, it has been suggested to either completely lubricate the threads themselves before contact with the ballooning action constraining rings or to use a lubricated ballooning action constraining ring. The invention is therefore concerned with a ballooning action constraining ring which can be used as a lubricated ballooning action constraining ring.

A lubricated ballooning action constraining ring with an oil distribution groove and a lining disposed therein is known from Chemifasern/Textilindustrie, August 1975, page 669, left column, second from last paragraph and FIG. 2, which lining is disposed at a radial distance from the threads to be lubricated, so that no direct contact takes place with the threads, but only the distant fibers brush against the oil-furnishing lining and the lubricant is brought in sparingly dosed amounts between the threads and the ballooning action constraining ring. The oil distribution groove with the lining is, for this reason, considered in the direction of course of the threads, disposed before the contact surface between thread and ballooning action constraining ring. The supply of lubricant to the lining disposed in the oil distribution groove can follow therewith by means of a wick. This known ballooning action constraining ring is complicated in construction and has moreover the disadvantage that indeed according to the number and length of the distant fibers of the thread to be lubricated, different amounts of lubricant are brought between the thread and the ballooning action constraining ring. This can have as a result that with shorter and less distant fibers, the lubrication is not sufficient, and with many and long-distanced fibers the amount of lubricant absorbed by the thread is too great. With this known ballooning action constraining ring a precise adjustment of the distance between thread or "thread balloon" and the lubricant-soaked lining to the thread characteristics (length and number of the distant fibers) is thus necessary. A further disadvantage possessed by these known ballooning action constraining rings is that a sufficient lubricant film is first adjusted after a long operational period, whereby upon starting-up of the apparatus the surface of the ballooning action restraining ring contacted by the thread is initially still dry, i.e. unlubricated. The formation of the lubricant film occurs as follows: A part of the lubricant absorbed by the distanced fibers of the thread is transferred by the contact surface of the ballooning action constraining ring. Since then, however, the thread, and not only the distanced fibers are in contact with the ballooning action constraining ring, a part of the lubricant delivered by the fibers is again absorbed and transported away by the other parts of the thread from the contact surface. An equilibrium state is then obtained when the same amount of lubricant is delivered per running meter of thread length at the contact surface is absorbed and transported away by the thread. Since with the known ballooning action constraining ring the lubricant however is brought only "in sparsely dosed amount" between thread and ballooning action constraining ring, it generally takes a very long time until such an equilibrium condition is obtained. A more considerable further disadvantage with these known ballooning action constraining rings is that they are not suitable for the working-up of filament yarns, since with these the distanced fibers responsible for the transport of lubricant are missing. These known ballooning action constraining rings have, probably for this reason, and if necessary still further disadvantages, not been able to be employed unlimitedly in practice.

A further disadvantage is that the lining of these known ballooning action constraining rings is quickly dirtied, whereby the oil delivery can quickly decline to the thread, so that this ballooning action constraining ring must be cleaned regularly and at brief time intervals during operation. A self-cleaning effect by means of the thread does not occur, since the contact only with the distanced threads is obviously not sufficient.

From German Auslegeschrift No. 2,351,974 there is known a tube-shaped ballooning action limiter for thread machines, the interior wall of which, stroked over by the thread balloon, is composed of a sinter substance of a plastic basis and indeed of low pressure polyethylene which, based upon its pore size, has a capillary action. As a result of the capillary action of the sintered polyethylene material the dosaging for the sliding film formation can be very finely undertaken, and indeed through choice of a suitable capillarity. The material employed therewith is absorbent, i.e., it has the capacity, based upon capillary action, to move liquids. The sinter material of low-pressure polyethylene basis has preferably a density of 0.61–0.66 g/cm$^3$ and a porosity of 27–35%. The mentioned reference teaches, moreover, that the material, based upon its pore size, has a capillary action; however no concrete statements are provided. Tests with ballooning action constraining rings of commercially obtainable sinter materials of low-pressure polyethylene yield based upon too small a resistance to wear or too high a lubricant delivery, results which are not useful for operational employment.

A further ballooning action constraining ring suitable for a storage of lubricant as detailed above, which is composed of a material which is suitable for absorbing lubricant and which so delivers at the fiber contact surface, that the friction stress of the thread is decreased by means of the thread contact surface is likewise known from Chemifasern/Textilindustrie, August 1975, p. 669, left column, last paragraph and right column, first paragraph. The raw material is sinter metal. In practice, it has however turned out that indeed for a short duration (a few days) the friction stress of the thread is decreased as a result of the lubricated ballooning action constraining ring, so that in order to maintain this activity the lubricant must be regularly replenished. The thread is therewith coated with lubricant, whereby a dirtying of the machine occurs. Frequent additional re-filling and cleaning work on the machine is a result. A wick embedded in this ring at the outside of the ballooning action constraining ring extends the refilling interval, but promotes more cleaning work, since the wick is quickly dirtied. Tests with ballooning action constraining rings of commercially customary sinter metals lead, based upon too high a lubricant delivery and more regular dirtying of the wick and also the entire machine, to results which are not useful.

SUMMARY OF THE INVENTION

It is therefore an object of the present invention to make available a ballooning action constraining ring of the above described type, with which the above described disadvantages are avoided, and by means of which the friction stress of the yarn remains decreased over great time periods (several months) and through which an increase in production efficiency is obtained with simultaneous reduction of the yarn injury.

This object is attained by a ballooning action constraining ring made of a material which is such that at least 15% of its volume (vol.-%) absorbs a lubricant, whereby the lubricant absorption is finished at the earliest after a course of about 15 minutes, and at least the surface of the ballooning action restraining ring coming into contact with the thread is composed of this material. Insertion of the ballooning action constraining ring according to the present invention is possible in spinning machines and threading machines.

It is particularly advantageous when the amount of lubricant absorbed into the material after about 15 minutes amounts to at most 25 vol-%.

The limits given according to the present invention (i.e., numerical values) apply for lubricant absorption at room temperature and atmospheric pressure. Under these conditions, the oil absorption curves represented in FIG. 16 were determined.

It has been shown that a raw material suitable for operational insertion into ballooning action constraining rings must not only be able to store a suitable lubricant in sufficient amount, but in other respects also be so constituted that it delivers the lubricant indeed in sufficient amounts, therewith however as sparsely as possible. There appears a connection between the absorption speed, thus the amount of lubricant absorbed per unit time, and the amount of lubricant consumed in operational use, thus per thread length, and indeed in so far as the desired smallest lubricant consumption it is only then guaranteed when also the lubricant absorption takes place sufficiently slowly.

The characteristic of storing lubricant in sufficient amount and delivering it again only in as small amounts as possible guarantees therewith thus a long-term operational use preparedness of the ballooning action constraining rings manufactured from such a raw material.

The apparatus can be used as follows, by way of example: For decreasing the friction between thread and ballooning action constraining ring, suitable lubricants are generally low-viscosity oils, for example ring oil, which are familiar to the expert. Such oils can also contain additives for improving the rinsability. The storage of the lubricants in the ballooning action constraining rings follows for example by means of sufficiently long immersion thereof in the oil involved. By means of interim removal and weighing of one or more samples of the ballooning action constraining ring to be impregnated, it can be established when the saturation state is obtained, i.e., the ballooning action constraining ring absorbs no more oil. Such a saturation state can be obtained at least with yet unused oil-free ballooning action constraining rings first after several hours, if necessary first after several days, whereby a saturation period numbering in days is of particularly advantage herewith, as already set forth above.

The ballooning action constraining rings according to the present invention requires therefore also no regular oil supply as is the case with the above described known ballooning action constraining rings, since with sufficiently careful dimensioning of the ballooning action constraining ring according to the present invention, and with suitable choice of raw materials, a sufficient amount of lubricant for an operational period numbering in months can be stored.

It is self-evident that raw material for the ballooning action constraining ring according to the present invention is only then suitable when it displays a sufficient lubricant staying behavior, i.e. when the lubricant previously absorbed, for example in an immersion bath, does not by itself again run out from the raw material. This can in simple manner be determined with samples of the raw material to be tested, in that they are initially soaked, until attaining saturation, in a suitable lubricant, for example oil, and after superficial drying they are hung up. A loss of lubricants possibly occurring therewith can then be determined qualitatively visually and quantitatively by means of weighing.

Frequently it is indeed not unconditionally necessary to wait for the saturation point, since already in the not completely saturated condition a sufficient amount of lubricant is stored, whereby it is however self-evident that the operational use preparedness of the ballooning action constraining ring according to the present invention continues so much the longer, the greater is the amount of lubricant stored therein.

Ballooning action constraining rings of commercially customary sinter metal, for example, have indeed a sufficient lubricant absorption capacity, and the saturation stage is reached with them already after several minutes. Ballooning action constraining rings of this type have therefore not been chosen for operational use.

The ballooning action constraining ring according to the present invention can be completely composed of a material which displays the characteristics according to the present invention. It can, however, also be composed of any optional further material, for example metallic, and only be provided with a ring-shaped lining or superimposed layer of such a raw material, whereby this is so dimensioned and arranged that the thread comes into contact with such a lining or layer exclusively upon ballooning in any case predominantly. Such a lining or layer can be tightly connected, either loosenably or non-loosenably, with the other parts of the ballooning action constraining ring according to the present invention.

It should be self-evident, moreover, that the raw material suitable for the ballooning action constraining ring according to the present invention, in view of the mechanical stress (friction) caused by means of the ballooning thread, must also display a sufficient resistance to wear, particularly a sufficient resistance to abrasion.

A ballooning action constraining ring according to the present invention composed of a metal or a raw material of a metallic basis generally displays the necessary resistance to wear. Other raw materials such as wood, plastics, and the like are, in expedient manner, first tested for their suitability. This can be done as follows: One or more ballooning action constraining rings are prepared from the raw material to be tested, and these are then tested under operational conditions for wear (abrasion, damage, and the like). A pre-selection can therewith be made by means of the Shore-Hardness Test technique, it having been shown that raw materials with a Shore Hardness in the range from 95–100 Shore display no determinable wear after months long operational use. Raw materials which, on the contrary, indeed based upon their lubricant absorption behavior, were suitable for production of ballooning action constraining rings, but which have a hardness in the region for example of about 75 Shore, have been shown to be unuseful already after several minutes or hours operational insertion as a result of strong abrasions, groove-or notch-formation, and the like. With the choice of the raw material suitable for the ballooning action constraining rings according to the present invention, attention must be paid in other respects that it does not become roughened, frayed or in any other manner give cause to any surface conditions which impair the thread characteristics, at the contact surface with the thread, based upon the friction produced by the ballooning thread in the course of time, but in all cases a further smooth finish should be experienced by means of the mentioned stress. In particular, sintered, pressed or other similar raw material or determined metal or raw material provided with natural or artificial fibrous components, lead to a considerable impairment of the thread characteristics after a brief operational employment, as a result of an impairment of the contact surface of the ballooning action constraining ring stressed by the thread.

According to the present invention, ballooning action constraining rings are suitable which provide an average hydrodynamic pore diameter of the raw material between 5 and 25 μm, and which display pores in the predominant part of the thread contact surface. The average hydrodynamic pore diameter is determined as follows:

Initially a cylindrical sample of the raw material to be tested is prepared, having a cross-sectional surface A and a thickness S. Therewith care must be taken that with regard to the orientation of the pores, the main orientation direction of the pores in the raw material lies as perpendicular as possible to the cross-sectional surface. In order to determine the average hydrodynamic pore diameter in each case, two oil-free samples are required, of which one is employed in dry state and the second having been completely soaked in ethanol (storage in ethanol for 24 hours).

Both samples are successively placed in a measuring arrangement which is described, for example, in DE-GM No. 82 12 094. In this measuring arrangement the timewise volume stream of nitrogen $\dot{Q}$ ($cm^3/s$ is measured before and after the sample in dependence upon the differential pressure Δp (Pa), and registered. From these measurements the nitrogen permeability P can be calculated.

$$P = \lim_{\dot{Q} \to 0} \frac{\dot{Q}/A}{\Delta p/S} \text{ in } \left(\frac{cm^2}{s \cdot Pa}\right)$$

The formation of the limiting value for very low throughput signifies that the kinetic loss of pressure, which is caused by the acceleration of nitrogen to the high flow speeds, does not falsify further calculations.

Moreover, the porosity of the samples is determined by weighing the samples in dry state and after 24-hours storage in ethanol. From this data the porosity ε (volume of cavities/total volume) can be calculated.

The average hydrodynamic pore diameter g is provided therewith from the equation $$d^2 = 32\eta P/\epsilon$$

whereby with the described measurement, η of $17.5 \cdot 10^{-6}$ Pa·s is used.

The preferred range for the average hydrodynamic pore diameter of a raw material according to the present invention lies between 10 and 20 μm, preferably between 18 and 14 μm. It has turned out according to the present invention that the most favorable average hydrodynamic pore diameter is a diameter of about 16 μm.

With the testing for suitable materials, it was surprisingly determined that certain types of wood provide the above mentioned characteristics in directly ideal combination. Thus, the wood types white beech, cherry wood, pear wood, Niove and red beech possess an oil absorption capacity which lies above 15% by volume, whereby the saturation with oil is not completely attained even after 72 hours, and the resistance to abrasion is extremely high. These wood types can moreover be worked up particularly favorably to remove splinters.

To facilitate joining and correction of thread breaks, the ballooning action constraining ring according to the present invention displays preferably a so-called thread slit, i.e. for this purpose a closed ballooning action constraining ring is completely separated through at a place, whereby a slit is formed, so that a thread can be inserted at the side by means of this slit into the ballooning action constraining ring, without it being necessary to sever the thread. Such a thread slit represents a source of disturbance, since at this place the otherwise closed contact surface of the ballooning action constraining ring is broken. The thread slit is for this reason to be so formed and disposed, that a prejudice to the ballooning action of the thread and an injury to the thread are avoided as extensively as possible. This additional object—facilitation of the servicing by means of a thread slit, without prejudice to the inherent function of the ballooning action constraining ring and the thread quality—is thereby attained according to the present invention in that the thread slit lies in a plane which runs inclined to the rotation axis of the ballooning action constraining ring. With this arrangement the thread slit is not visible in plan view, but only in a side view.

The ballooning action constraining ring according to the present invention represents without the thread slit a rotation body (body of revolution). This arises—seen from a mathematical viewpoint—when one allows a surface to rotate perpendicular to its normal about an axis, the so-called axis of rotation. With the ballooning action restraining ring according to the present invention this surface corresponds to the cross-sectional surface of the ring. The axis of rotation (or axis of revolution) of the ballooning action constraining ring according to the present invention is therewith thus a line, the points of which remain at rest upon a rotation of the ballooning action constraining ring, or, expressed in another manner, such an axis by means of which one obtains the cross-sectional surface of the ballooning action constraining ring.

The angle of slope between the axis of rotation and the plane of the slit lies advantageously in the range from 25° to 50°.

Indeed it is also possible to provide an arrangement of the thread slit in a plane which runs parallel to the axis of rotation, however not through the same.

With such an embodiment the ballooning action of the thread is, however, even if only insignificantly, disturbed, and there occurrs after a short time in the range of the thread slit an indeed locally limited, however frequently strong, wear and tear, which for its part can lead to thread injuries. In other respects with this embodiment, one must consider the direction of rotation of the thread "balloon", in so far as construction is concerned, since otherwise the thread will run outwardly through the thread slit by means of the centrifugal force prevailing upon the effecting of the ballooning action. This embodiment is therefore less preferred.

The cross section of the ballooning action constraining ring according to the present invention can be optionally selected. At least in the range of the mutual contact between thread and ballooning action constraining ring, it is advantageously rounded off or arched. In other respects, technical production points of view can be decisive for selection of the ring's cross section. Thus, for example, a more rounded cross section, indeed according to the type of production of the ballooning constraining ring according to the present invention, can be a particularly advantageous or even a less to be preferred embodiment.

The surface of the ballooning action constraining ring according to the present invention must obviously meet the customary requirements, i.e. for example, it must be sufficiently smooth, which, e.g. when not already provided as a result of the type of preparation, can be obtained through subsequent polishing.

The ballooning action constraining ring according to the present invention has particularly been proven useful, where conventional rings lead to force/elongation loss or yarn injuries or where these can only be avoided by means of a lower production speed. This is particularly the case with polyester fiber yarns or mixed yarns with polyester fibers as one of the mixed yarn components. The ballooning action constraining ring according to the present invention thus provides an increase in production with simultaneous improvement of the yarn quality, whereby production increases of 10–20%, with delicate yarns even of 30% and above, relative to the previously practical production speeds, can be obtained without difficulty. The ballooning action constraining ring according to the present invention can advantageously also be used for the production of spin fiber yarns of 100% natural fibers.

Also when the ballooning action constraining ring according to the present invention is used preferably with the production of spin fiber yarns, thus yarns with distanced fiber ends, it is similarly suitable for the working-up of smooth yarn without distanced fibers, since it does not require distanced fibers for transportation of the lubricant between thread and apparatus. The ballooning action constraining ring according to the present invention is thus universally useful.

The operational utilization period for the ballooning action constraining ring according to the present invention generally exceeds the customary machine running period, so that an exchange of consumed rings according to the present invention can be performed within the scope of the customary cleaning and reconditioning operations. Used rings according to the present invention can generally be re-used several times, whereby the consumed amount of lubricant is only required to be again provided, for example by means of immersing the ring in the desired lubricant, e.g. oil. Indeed according to stress, even a slight after-polishing of the contact surfaces can be noticed.

The outstanding characteristics of the ballooning action constraining ring according to the present invention include, among others, that it is clearly possible, indeed according to yarn strength and type of fiber, to produce per ring, several thousand kilometers yarn with a lubricant consumption of only about 1 g, which, according to type of operation, corresponds to a stand time, i.e. an operational readiness without replenishing of the consumed amount of lubricant, of several months up to a year and more.

A cleaning of the ballooning action constraining ring according to the present invention is not necessary with months long operational periods, since the contact surface is continuously held free of deposits by means of the ballooning action of the thread.

The replenishing of the consumed lubricant can, if a liquid lubricant is involved, be performed by means of further embodiments of the ballooning action constraining ring according to the present invention, even during the operational use, i.e., thus without it having to be dismantled specifically for this purpose. This is attained, for example, by disposing on the upper side of the ballooning action constraining ring a recess formed in the shape of an open canal, which can be formed as a closed ring-shaped canal, or however, with the presence of a thread slit, only on both sides thereof. This reservoir, also designated as a lubrication groove, can upon need or continously completely or partially be filled with the employed liquid lubricant, which then penetrates by itself gradually into the ballooning action constraining ring.

If the ballooning action constraining ring according to the present invention is disposed in a support, based upon the type and arrangement of this support, such a lubricant reservoir can be provided at any optional side of the ring between it and the supports. Therewith it is possible to form the lubricant reservoir as an outwardly completely closed ring canal which is proportioned correspondingly large for absorption of a sufficient supply of lubricant for a very long time period, or which displays an outwardly leading, if necessary closable, refill opening. Such a closed ring canal, or one ending before the thread slit, is, for example, by means of a recess corresponding in shape to an open canal, formed at the periphery or the bottom side of the ballooning action constraining ring, which is covered by the support and is therewith closed.

It is also possible according to further embodiments to arrange several ballooning action constraining rings according to the present invention superposed in optional number, whereby the arrangement can be as narrow as desired, so that the superposed ballooning action constraining rings according to the present invention form a tube-shaped unit.

Herewith it is not required that the superposed ballooning action constraining rings must unconditionally have the same diameter, i.e. the rings can have, in the direction of course of the thread, for example a widening, a narrowing, or initially a widening and then again a narrowing diameter.

The so-called pliable wood, which in cold state with a ratio of wall thickness to radius of curvature from 1 to 10 or more, can be conveniently bent without breaking, i.e. for example a 10 mm thick strip can after bending display a radius of 100 mm, and which can be fixed in any curved or straight condition by exposing for several hours to dry heat of 60°-75° C., is also suitable for the ballooning action constraining ring according to the present invention. With this raw material it is possible to produce the ballooning action constraining ring according to the present invention from straight strip-shaped pieces by means of bending and subsequent fixing. Therewith an embodiment has proven to be particularly advantageous wherein the ends of the wood strip are not joined together upon bending into a butt joint, but the strip is curved into a screwline-shaped cylindrical coil, in which the ends overlap without touching. Such a ballooning action constraining ring appears in plan view as a closed ring, whereas in a side view the spiral-shaped course and the sloped thread slit are visible between overlapping ends. This shape is known from ballooning action constraining rings of thick wire.

Obviously, it is also even possible with the use of flexible wood to develop the ballooning action constraining ring according to the present invention in a manner described further above.

In other respects, it is possible with the use of flexible woods to produce a coil spring-shaped ballooning action constraining ring according to the present invention with optionally many windings, from an appropriately measured strip with a suitable cross-sectional shape.

This last-described, coil-spring-shaped embodiment is not limited to the cylinder shape, but the windings can also run at decreasing or increasing distances from the longitudinal axis, so that a ballooning action constraining ring according to the present invention embodied in this manner can have, for example, the shape of a barrel or a truncated cone.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
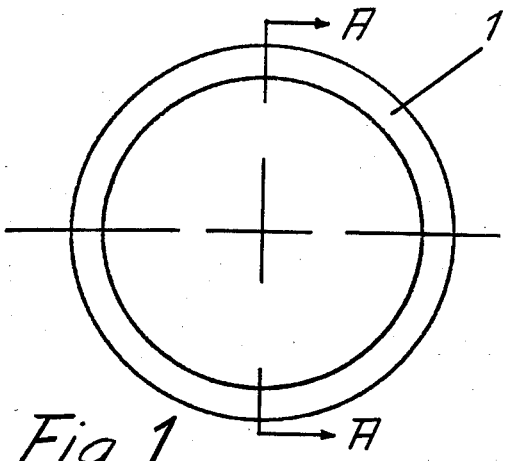
FIG. 1 is a plan view of an embodiment of the ballooning action constraining ring according to the present invention.
Figure 2:
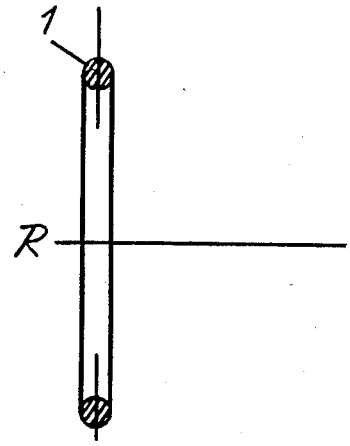
FIG. 2 is a view along the section A—A of the ballooning action constraining ring according to FIG. 1.

FIGS. 1 and 2 show a ballooning action constraining ring 1 according to the present invention in a very simple embodiment in plan view and in cross section A—A. The ballooning action constraining ring has no thread slit and thus represents a very favorable embodiment for the working up of yarn. The cross section of the ballooning action constraining ring 1 is circular. It can, however, also be formed otherwise. For each cross-sectional shape it is, however, to be observed that the thread contact surface should be as rounded off as possible, whereby the shoulder is disposed towards the thread.

Figure 3:
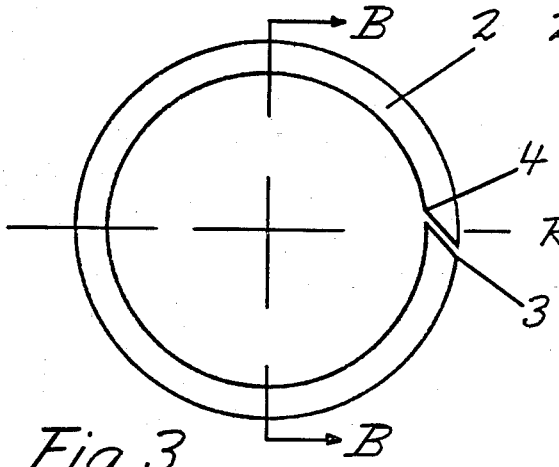
FIG. 3 is a plan view of a further embodiment of the ring, having a thread slit.
Figure 4:
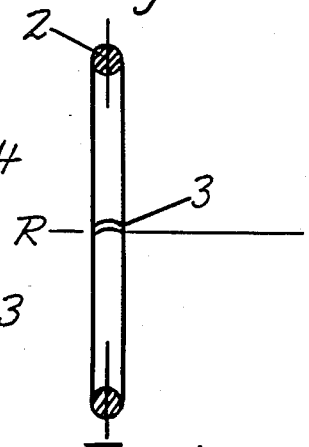
FIG. 4 shows the section B—B of the ring according to FIG. 3.

FIGS. 3 and 4 show a further embodiment of a ballooning action constraining ring 2 according to the invention with a thread slit 3, the plane of which runs parallel to the axis of rotation R, however not through it, in plan view and in cross section B—B. With such an embodiment, upon longer operational periods, an insignificant wear occurs at the place designated by 4 at the thread slit 3, so that an insignificant injury to the thread can result.

Figure 5:
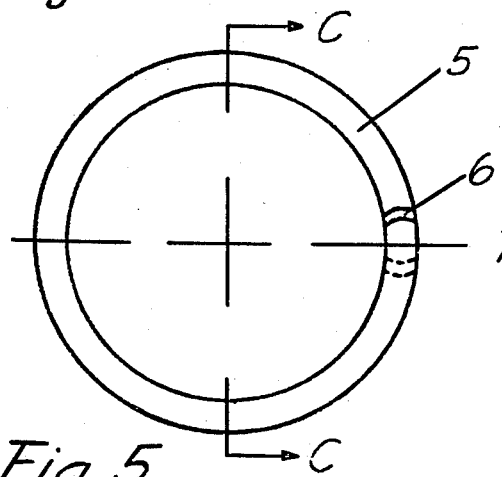
FIG. 5 is a plan view of an improved embodiment of the ring with thread slits.
Figure 6:
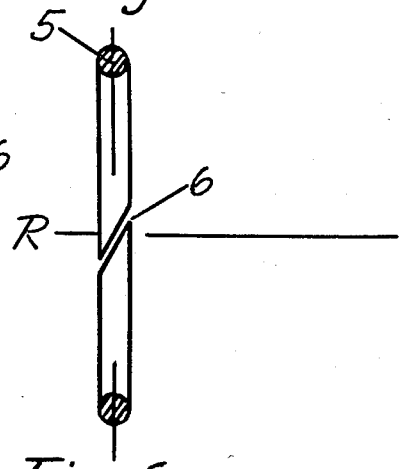
FIG. 6 is a view along the section C—C of the ring according to FIG. 5.

FIGS. 5 and 6 show a favorable embodiment of a ballooning action constraining ring 5 according to the present invention with round cross section and a thread slit 6, the plane of which is sloped to the axis of rotation R. The attitude of the thread slit 6 is to be so selected that in a side view the thread slit 6 can be seen. With this embodiment, also after longer operational times, no injury in the range of the thread slit 6 (on the thread contact side) can be determined.

With the above described embodiments of the ballooning action containing ring according to the present invention, the entire ring is composed of a material which possesses the inventive characteristics. Such rings can, however, also be employed in the form of a lining in a stable support.

Figure 7:
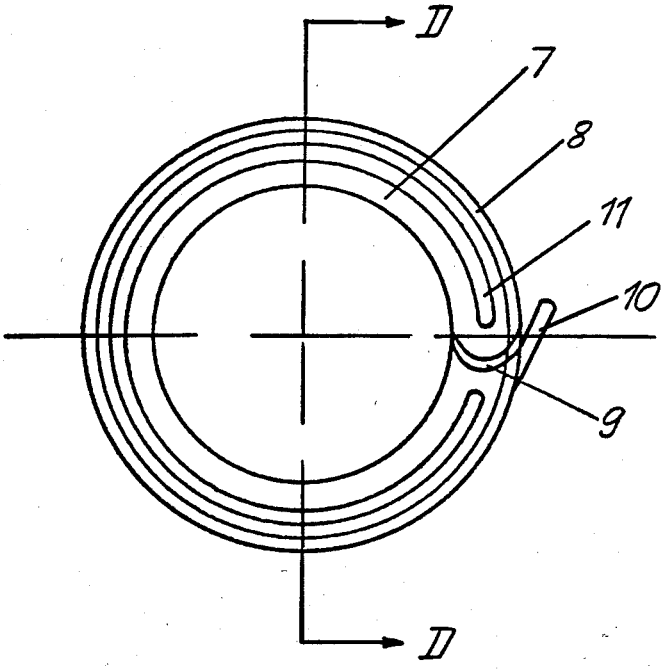
FIG. 7 is a plan view of a favorable embodiment of the ring with thread slit, threading aids and lubricant groove.
Figure 8:
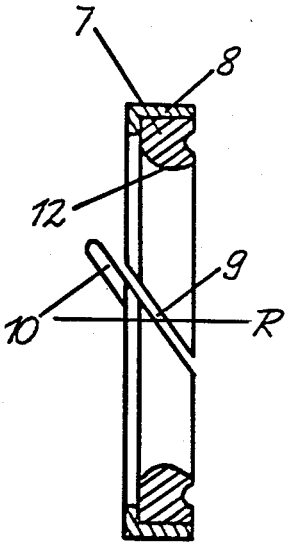
FIG. 8 is a view along section D—D of the ring according to FIG. 7.

FIGS. 7 and 8 show in plan view and in section D—D a particularly advantageous embodiment of a ballooning action constraining ring according to the present invention, which is composed of a housing 8 of, for example, rustfree steel and a lining 7 of a material which possesses the inventive characteristics. The lining 7 is in more favorable manner connected force-locking or form-locking with the housing. The cross section of lining 7 has the shape of a right angle, the thread contact surface 12 of which is rounded off, whereby the curvature is disposed toward the thread. The ballooning action constraining ring 7, 8 displays a thread slit 9, the plane of which is disposed sloped about 45° to the axis of rotation R of the ballooning action constraining ring 7, 8, whereby the slit is not visible in plan view. In order to facilitate the threading of the thread, a peg 10 is arranged as a threading aid, the surface of which is tangent from the outside to the plane of the thread slit 9. A lubricant groove 11 in the shape of an open canal is disposed running about the top side of the ring 7, 8, and which canal ends on both sides of the thread slit 9.

Figure 9:
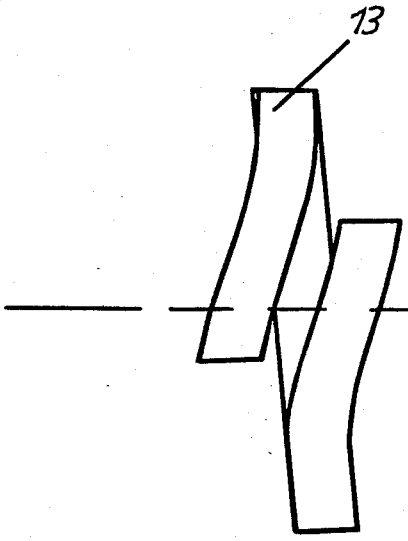
FIG. 9 is a side view of a ring according to the invention curved like a helix with a winding.
Figure 10:
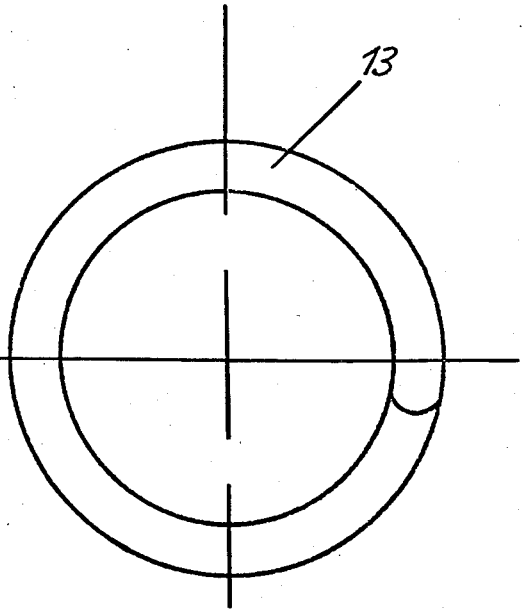
FIG. 10 is a plan view of the ring according to FIG. 9.
Figure 11:
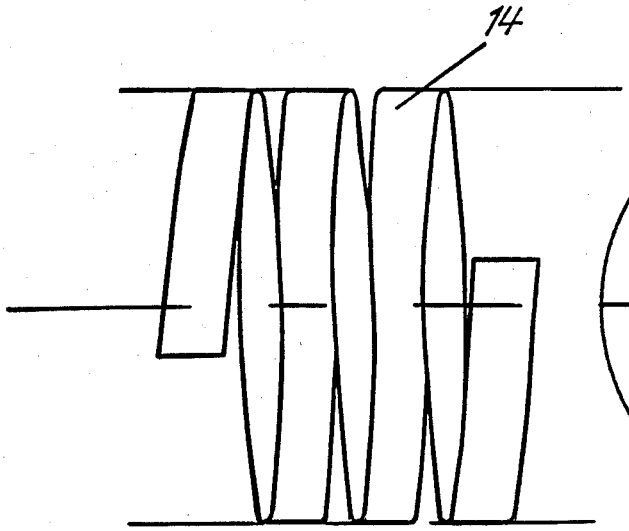
FIG. 11 is a side view of a ring bent into a helix shape, having three windings.
Figure 12:
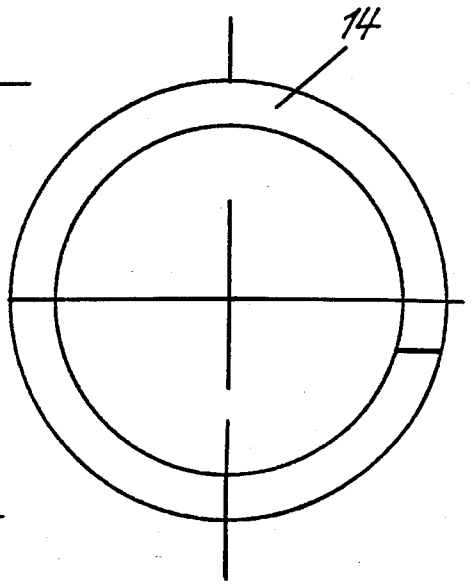
FIG. 12 is the plan view of the ring according to FIG. 11.

FIGS. 9, 10, 11 and 12 show, as further embodiments, a helix-shaped curved ring 13 or 14, each in side view and plan view, whereby in FIG. 9 and 10 the ring 13 displays one winding, and in FIGS. 11 and 12 three windings. For this, all materials are suitable which possess the inventive characteristics and which can be bent into this shape. Particularly suitable is the so-called pliable wood, which is described, for example, in DE-PS No. 946 479. With only one winding for the helical shape curved ring 13 (FIGS. 9, 10), it is necessary for a more certain running of the thread, that both ends of the ring 13 be disposed overlapping. In the event that several windings are provided for a ring of this shape (for example three, as in FIGS. 11 and 12), it is also possible to dispose the individual helical shaped windings in different distances to the longitudinal axis, for example in the shape of a barrel or a truncated cone.

Figure 13:
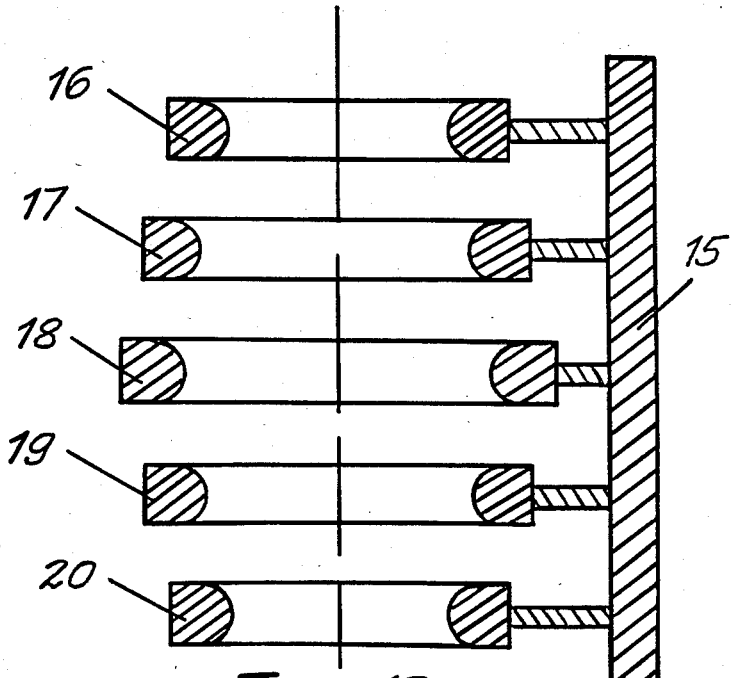
FIG. 13 shows a section through a ballooning action constraining ring, in which five rings of different interior diameters are disposed superposed.

FIG. 13 shows in cross section a ballooning action constraining ring, with which five rings 16–20 are superposed in a support 15. The rings have different diameters. The largest interior diameter belongs to the ring 18 disposed in the middle. Proceeding from both sides of ring 18, the interior diameters for the rings 17 and 19, and then for the rings 16 and 20, are each dimensioned smaller. The spatial shape enclosed by the rings 16, 17, 18, 19, 20 as the form of a barrel. If herewith a ballooning action constraining ring with thread slit (not represented) is preferred, it is expedient to furnish all five rings 16, 17, 18, 19, 20 with a thread slit.

Figure 14:
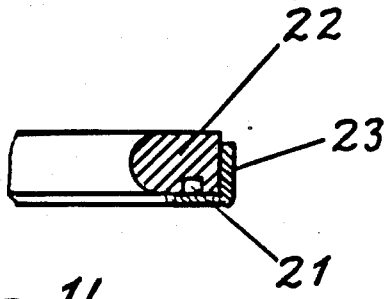
FIG. 14 shows a partial section through a ring according to the present invention.
Figure 15:
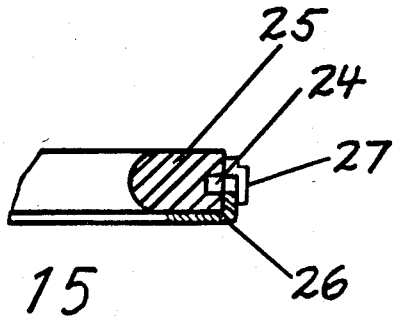
FIG. 15 shows a partial section through a further ring according to the invention.

FIGS. 14 and 15 show in each case a partial section of further possibilities for the arrangement of a lubricant groove for the ballooning action constraining ring according to the present invention. In FIG. 14 the lubricant groove 21 lies on the bottom side of lining 22 which is composed of a material possessing the inventive characteristics. This lubricant groove 21 is outwardly closed by means of a housing 23. The lubricant groove 21 can be disposed running around, however with the presence of a thread slit, it must be sealed with regard to the thread slit.

For filling of the lubricant groove 21, the lining 22, not to speak of the housing 23, is turned around, so that the lubricant groove 21 is exposed uppermost. After filling of the lubricant groove 21 with lubricant, the housing 23 is placed tightly and connected force-locking or form-locking with the lining.

In FIG. 15, the lubricant groove 24 is disposed at the outside of the ballooning action constraining ring, and projects through the housing 26 across into the outer periphery of the lining 25, which is composed of a material possessing the inventive characteristics. By means of a capping 27 at one or more places on the periphery of the ballooning action constraining rings, the lubricant grooves can be outwardly closed. By means of removal of the capping 27, the lubricant groove 24 can be filled again with lubricant in simple manner after consumption thereof.

Figure 16:
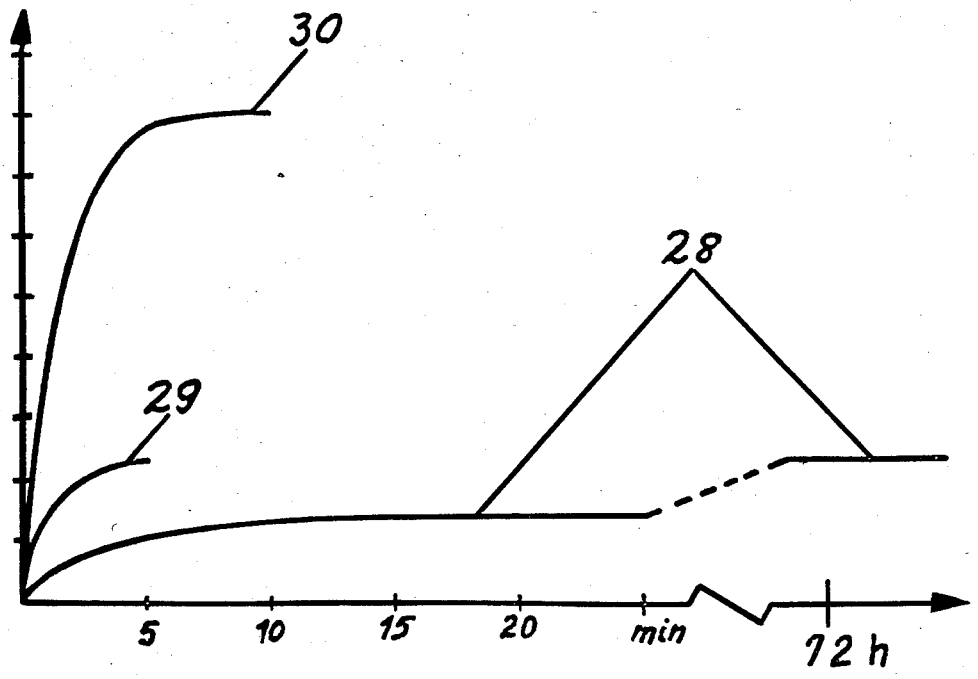
FIG. 16 is an oil absorption curve of the ring according to the invention, with comparison curves of two non-inventive rings.

In FIG. 16, the oil absorption of three different materials, is represented over a period of time. These oil absorption curves are necessary for selection of material for the ballooning action constraining rings according to the main patent application No. P 32 48 238. In order to attain these curves, in each case several rings of the particular, above designated materials are immersed in a commercial ring oil with a viscosity of 9.7 cSt at 50° C., which neither is resinified nor stuck together and is oxidation-free. After brief periods of time, the ballooning action constraining rings are weighed. The weight additions show the amounts of absorbed oil. These amounts of absorbed oil are then used to determine the absorbed oil volume portion of the entire ring.

For example, a ballooning action constraining ring weights 12.1 g and has a volume of 15.3 $cm^3$. When, after 5 min., the ring weighs 13.5 g, then it has absorbed 1.4 g of oil, which corresponds to a volume of oil of 1.6 $cm^3$. Therewith one determines that the ballooning action constraining ring has absorbed a 10.5 volume percent of oil.

Other low-viscosity ring oils or other oxidation-free oils, which are not resinified or stuck together, for example also white oil, can be employed for lubricating the ballooning action constraining ring with good operational results.

Curve 28 shows a material displaying the characteristics desired, namely white beech wood.

For comparison, curve 29 shows the results using a sinter metal, and curve 30 a polypropylene raw material displaying pores.

With the sinter metal (curve 29) the oil absorption was already finished after 5 minutes, whereby 23 volume-% of oil was absorbed. As mentioned several times above, such a sinter metal ballooning action constraining ring shows good characteristics at the start. After several days, however, an injury to the yarn can be determined. This depends obviously on the characteristics of this ring as shown in curve 29. The sinter metal ballooning action constraining ring stores, indeed, sufficient oil (23 vol.-%), but the absorption of lubricant is terminated already after 5 minutes. Obviously, this results in the stored amount of oil also being quickly redelivered (i.e., within several days). This is evidenced by an increase in the yarn injury.

With a ballooning action constraining ring composed of a porous polypropylene material (curve 30), it has been determined that the oil absorption is terminated within 10 minutes, whereby this material can store 80% by volume of oil. Also with this material it has been determined that upon use of such material for a ring, the oil delivery to the thread follows within several hours. This is evidenced, moreover, by an injury to the yarn to be treated. In addition, a dirtying of the ring spinning machine by means of the oil is determined.

With a ballooning action restraining ring which is composed of a material displaying the desired characteristics, the oil absorption runs in the manner represented, for example, by curve 28. This curve shows the results of the determination of oil absorption of a ballooning action constraining ring of white beech wood. After 15 minutes, about 14 volume-% oil is absorbed by this material. Thereupon it can be determined that the ballooning action constraining ring continuously absorbs further oil, until after 72 hours a stored amount of oil of about 23 volume-% is obtained. This results, as should be more closely illustrated in the following examples, in a utility cycle for rings of white beech wood of 9 months and more, in three-layer operation, without further after-dosaging, and with good results with regard to the working up of the yarns.

The oil absorption can be accelerated by means of treatment in heated oil under vacuum conditions (according to the type of boiler pressure impregnation).

Obviously, a close connection exists between the storage capacity of at least 15 vol.-%, the oil absorption speed of at most 25 vol.-% within the first 15 minutes after immersion, and the duration of lubricant absorption, which is closed off at the earliest after 15 minutes, on the one hand, and a sufficient, but very low lubricant delivery, which is of advantage for continuous (several months) good results for the working up of yarn on ring spinning machines.

It has now been determined that the ballooning action constraining ring of which at least the surface coming into contact with the thread is composed of a raw material which is suitable to absorb at least 15% of its volume of a lubricant, and the thread contact surface of which is such as to decrease the friction stress of the thread by means of the thread contact surface, whereby the lubricant absorption at the earliest finishes after a run of 15 minutes, provides likewise good results when the average hydrodynamic pore diameter of this raw material lies between 5 and 25 μm. For this purpose, in FIGS. 18 and 19 there are represented two pore distribution curves for rings made of materials according to the present invention.

Figure 18:
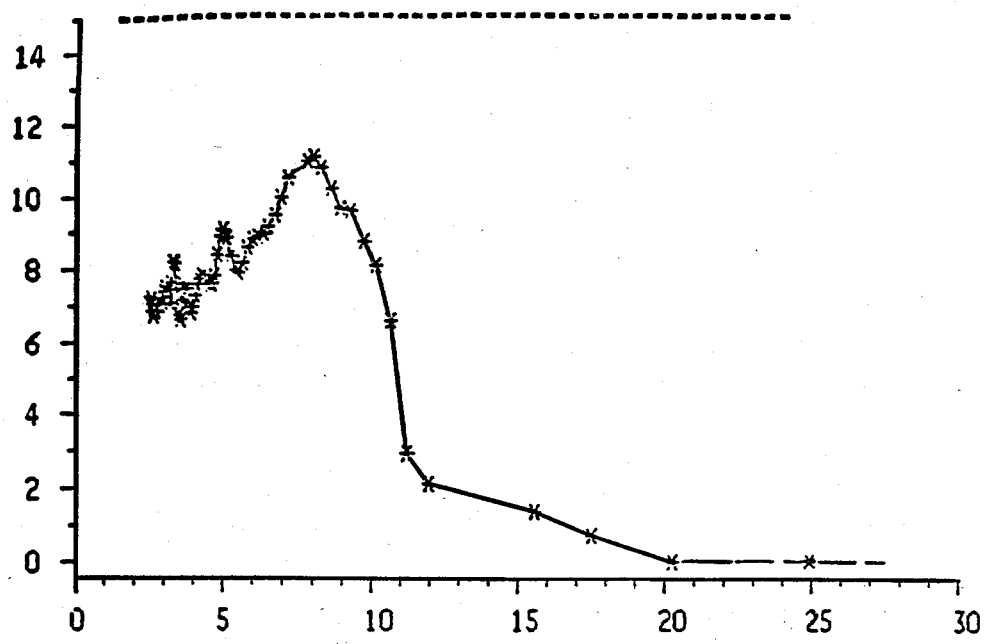
FIG. 18 is a pore distribution curve of a ballooning action constraining ring from a raw material according to the present invention, here white beech.

FIG. 18 involves the pore distribution curve of white beech. The porosity $\epsilon$, provided from the already described measurements, came to 0.47, and the permeability was $220 \cdot 10^{-5}$ cm²/s·Pa, from which an average hydrodynamic pore diameter of 16 μm is calculated.

Figure 19:
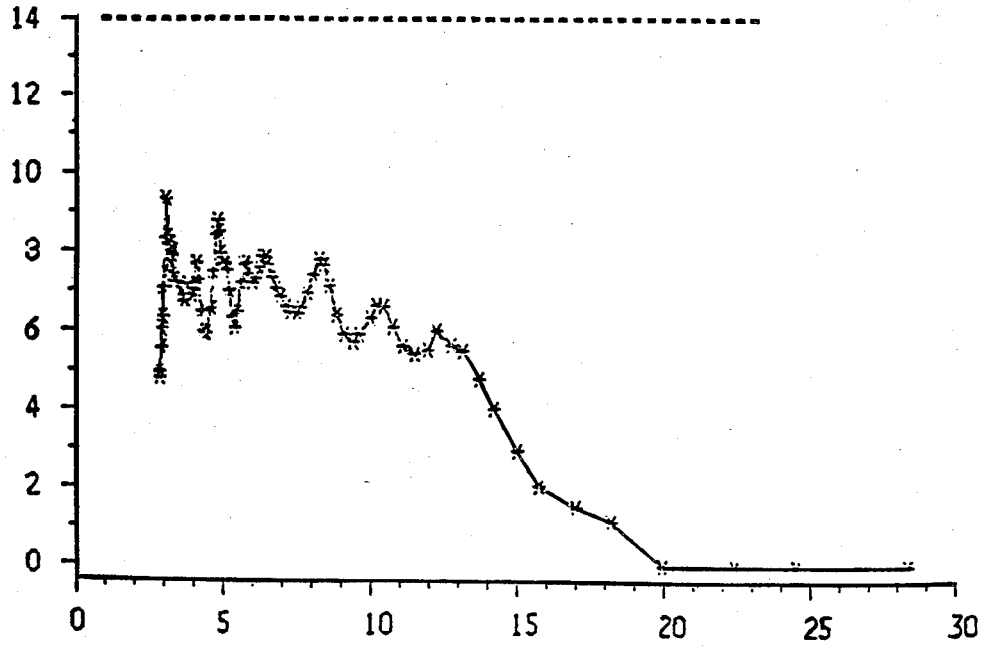
FIG. 19 is a pore distribution curve of a ring prepared from a further raw material according to the invention, here red beech.

FIG. 19 shows a pore distribution curve for red beech. The porosity came to 0.281, and the permeability came to $170 \cdot 10^{-5}$ cm²/s·Pa, whereby an average hydrodynamic pore diameter of 18.5 μm was calculated.

With ballooning action constraining rings of white beech and of red beech, care must be taken that the preponderant portion of the thread contact surface displays pores, since with wood raw materials, an orientation of the pores is always present. Rings from wood must to this extent be produced from boards which are cut in the longitudinal direction of the stock. Slices or cuts transverse to the direction of the axis of the stock are poorly suitable for the rings according to the present invention, since only very few pores are provided on the thread contact surface.

With the use of ballooning action constraining rings according to the present invention of white beech or red beech in spinning, it can be determined that ballooning action constraining rings of white beech require a refilling with oil first after about 4000 km of spun yarn, whereas rings of red beech must be refilled after about 2500 km of spun yarn.

EXAMPLE 1

Ballooning action constraining rings of different materials, which display the characteristics according to the invention, are left standing for about 12 hours in a commercial ring oil (36 c St at 20° C. C, 16.6 c St at 40° C., oxidation-free no tendency to resinification or sticking together). The tested materials were white beech, cherry wood, pear wood, Niove and red beech. The construction of the rings corresponded to that represented in FIGS. 7 and 8. The interior diameter of the ballooning action constraining rings amounted to 52 mm. As yarn, a dtex 250×1 (Nm 40/1) yarn of a cotton type of normal polyester was worked up on a ring spinning machine.

The running velocity amounted to 32 m/s. The prepared yarn displayed a twist of about 100. For each ballooning action constraining ring, a total of 120,000 m yarn were spun. After the employment of the rings no injuries could be determined therein (i.e., no abrasion, indentation, or the like).

Figure 17:
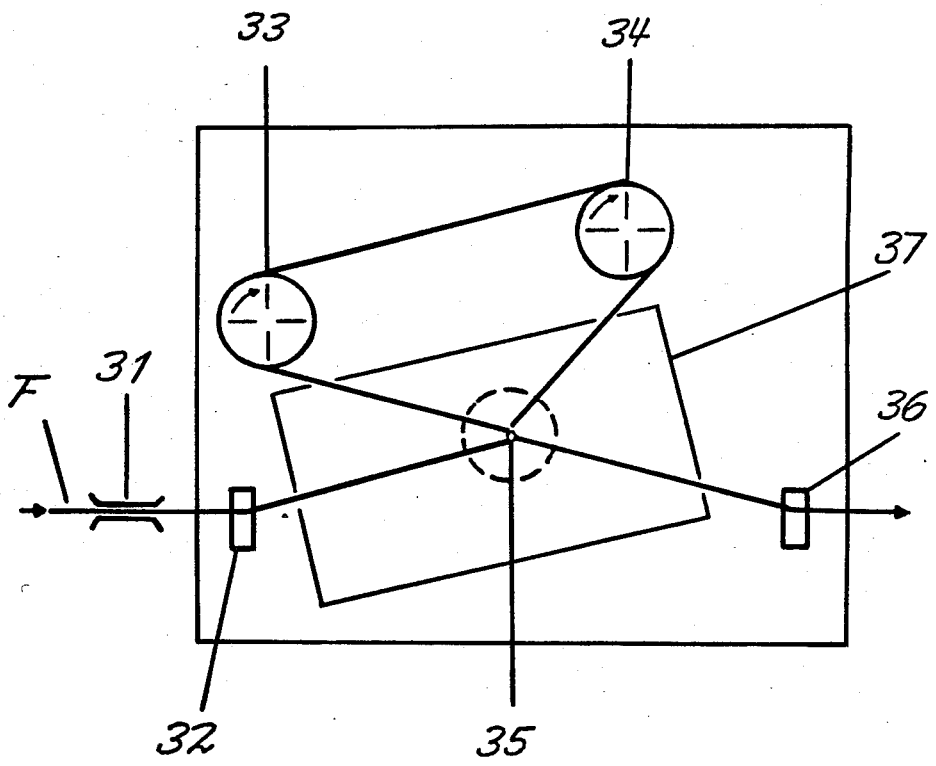
FIG. 17 is a schematic representation of a testing apparatus for measuring the injury to yarns after the working-up on ring spinning machines.

The quality of the yarn is then determined by an abrasion test, which has been designated a Staff-Abrasion Test. With this abrasion test an apparatus is employed as is represented in FIG. 17. Herewith the thread F is led across a thread brake 31, a thread guide 32 and across two guide rollers 33, 34. The threads running towards guide roller 33 are themselves rolled about by the threads coming from the guide roller, which are removed from the apparatus across the thread guide 36 by non-represented means. Below the winding-around point 35, at which the threads are wound about themselves, lies a dust-catching surface 37, which catches the fiber particles falling by means of abrasion. The amount of the fallen dust, relative to the amount of thread run through the apparatus, in mg dust per 10 g yarn, gives information about the yarn injury resulting from the ring spinning . The introduced thread tension is about 3 p. Further indications of usefulness for the ballooning action constraining ring according to the present invention are provided from the tensile strength and the elongation of the treated yarn.

The results are summarized in Table I.

TABLE I

| Material of the ballooning action constraining ring | | | white beech | cherry wood | pear wood | Niove |
|---|---|---|---|---|---|---|
| Elongation at break % | tips | A | 14.3 | 13.9 | 13.9 | 14.1 |
| | | B | 13.9 | 12.9 | 13.5 | 13.7 |
| | base | A | 14.5 | 13.9 | 14.1 | 14.3 |
| | | B | 14.9 | 13.9 | 14.3 | 14.1 |
| tensile | tips | A | 34.2 | 34.7 | 34.1 | 33.8 |

TABLE I-continued

| Material of the ballooning action constraining ring | | | white beech | cherry wood | pear wood | Niove |
|---|---|---|---|---|---|---|
| strength | | B | 31.6 | 31.2 | 33.2 | 32.5 |
| cN/tex | base | A | 33.4 | 33.9 | 34.6 | 34.7 |
| | | B | 33.8 | 33.9 | 36.3 | 33.4 |
| Staff- | tips | A | 0.83 | 0.47 | 0.54 | 0.57 |
| Test | | B | 0.75 | 1.04 | 0.95 | 0.84 |
| mg dust | base | A | 0.25 | 0.12 | 0.16 | 0.27 |
| per | | B | 0.15 | 0.18 | 0.13 | 0.35 |
| 10 g yarn | | | | | | |

Designations are as follows:
tips: the upper half of the cop development
base: the bottom half of the cop development
A: after 4,000 m yarn treatment (tips)
B: after 40,000 m yarn treatment (tips)

From Table I it is evident that, upon use of the ballooning action constraining rings according to the present invention, despite higher production speeds with polyester fiber yarn, uniformly good tensile strength and elongation at break values can be obtained across the cop, whereby the injury of the yarn, measured in the Staff Abrasion Test is as small as possible.

EXAMPLE 2

Different yarns were spun, whereby ballooning action constraining rings according to the present invention, having linings composed of white beech wood, are employed as set forth in the embodiments of FIGS. 7 and 8. Before insertion of the rings, they are left standing for 12 hours in ring oil (36 cSt at 20° C., 15.6 cSt at 40° C., oxidation-free, no tendency to resinification or sticking together).

The following yarns were tested:

| | | |
|---|---|---|
| Yarn 1 | combed cotton | dtex 250 × 1 |
| Yarn 2 | cotton type of acrylic | dtex 250 × 1 |
| Yarn 3 | wool type of modified polyester | dtex 250 × 1 |
| Yarn 4 | cotton type of normal polyester | dtex 250 × 1 |

The tests are performed with two thread running velocities. The results are set forth in Table II.

TABLE II

| | rollar speed | | Yarn 1 | Yarn 2 | Yarn 3 | Yarn 4 |
|---|---|---|---|---|---|---|
| Elongation at break % | 29 m/s | tips | | 23.7 | | |
| | | base | | | | |
| | 32 m/s | tips | 6.3 | 22.1 | 16.3 | 13.9 |
| | | base | 5.7 | 23.7 | 16.9 | 14.9 |
| | 35 m/s | tips | 6.5 | | 17.3 | |
| | | base | 6.1 | | 16.9 | |
| Tensile Strength cN/tex | 29 m/s | tips | | 17.1 | | |
| | | base | | | | |
| | 32 m/s | tips | 13.7 | 16.3 | 19.4 | 31.6 |
| | | base | 13.0 | 17.6 | 21.2 | 33.8 |
| | 35 m/s | tips | 13.7 | | 21.1 | |
| | | base | 12.7 | | 20.8 | |
| Staff-Test mg dust/10 g yarn | 29 m/s | tips | | 0.29 | | |
| | | base | | | | |
| | 32 m/s | tips | 2.55 | 0.87 | 0.08 | 0.75 |
| | | base | 2.20 | 0.56 | 0.08 | 0.15 |
| | 35 m/s | tips | 2.59 | | 0.08 | |
| | | base | 2.17 | | 0.12 | |

From Table II it is evident that:

Cotton provides favorable results customary with cotton, also with the ring according to the invention.

With yarn of acrylic, while retaining the favorable elongation and tensile strength characteristics and a good resistance to abrasion, speeds of up to 32 m/s are obtained.

The very delicate wool type of modified polyester provides also with speeds of 35 m/s good results with regard to elongation and tensile strength, and excellent results with regard to resistance to abrasion.

The results from Example 1 for the cotton type from normal polyester have been undertaken for the sake of completeness.

EXAMPLE 3

A ring spinning machine was provided with a ballooning action constraining ring according to the present invention of white beech wood, the embodiment according to FIGS. 7 and 8. The rings were soaked for 12 hours in ring oil having 9.7 cSt at 50° C. Various polyester yarns were then spun in a three-layer operation, for 5 days a week. After about 1 year, within which period a total of 4,000 km yarn per spinning stand were spun with uniformly good characteristics, the ballooning action constraining rings were dismantled and weighed. During this period about 11.5 vol.-% of oil was consumed. The effective amount of consumed oil per spinning stand came to about 1 g.

By means of the lubricant groove 11, a dismantling of the ballooning action constraining ring is not necessary. After refilling of the consumed amount of oil, which is again absorbed after 2–3 days by the white beech wood ring, practically an uninterrupted use of the rings is possible, whereby a dirtying of the machine does not occur, and particularly with polyester yarns a 15% increase in production is obtained, with simultaneous uniformity and improvement of the yarn characteristics.

It will be understood that each of the elements described above, or two or more together, may also find a useful application in other types of friction-decreasing means, differing from the types described above.

While the invention has been illustrated and described as embodied in a ballooning action constraining ring, it is not intended to be limited to the details set forth, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a constraining ring of the type used in the working up of fibers to prevent ballooning action thereof, the improvement wherein said ring is composed of a raw material suitable for absorbing lubricants, said ring having a thread contact surface which reduces the friction load of a thread by means of the thread contact surface, and wherein said raw material absorbs a lubricant to at least 15% of its volume, whereby absorption of the lubricant is completed at the earliest after about 15 minutes, and at least a surface of said ring which contacts with a thread is composed of said raw material, said ring having an average hydrodynamic pore diameter of said raw material between 5 and 25 μm and a preponderant portion of said thread contact surface displays pores.

2. Ballooning action constraining ring according to claim 1, wherein an amount of lubricant absorbed into said raw material after 15 minutes amounts at most to 25 volume-%.

3. Ballooning action constraining ring according to claim 1, wherein said average hydrodynamic pore diameter of said raw material lies between 10 and 20 μm.

4. Ballooning action constraining ring according to claim 3, wherein said average hydrodynamic pore diameter of said raw material lies between 14 and 19 μm.

5. Ballooning action constraining ring according to claim 4, wherein said average hydrodynamic pore diameter of said raw material is about 16 μm.

6. Ballooning action constraining ring according to claim 1, wherein said raw material is wood.

7. Ballooning action constraining ring according to claim 6, wherein said raw material is selected from the group consisting of white beech, cherry wood, pear wood, Niove, red beech and pliable wood.

8. Ballooning action constraining ring according to claim 1, wherein said ring defines a thread slit running therethrough.

9. Ballooning action constraining ring according to claim 8, wherein said thread slit has a plane which runs inclined to the axis of rotation of said ring.

10. Ballooning action constraining ring according to claim 9, wherein angle of incidence between said plane of said thread slit and said axis of rotation lies in the range from 25° to 50°.

11. Ballooning action constraining ring according to claim 1, wherein the thread contact surface of said ring is formed curved.

12. Ballooning action constraining ring according to claim 1, wherein a groove is defined outside of said thread contact surface, disposed in said raw material which absorbs the lubricant.

13. Ballooning action constraining ring according to claim 1, wherein said lubricant absorbing raw material is employed as a lining in a support.

14. Ballooning action constraining ring according to claim 13, further comprising a lubricant reservoir between said lining and said support.

15. Ballooning action constraining ring according to claim 14, wherein said lubricant reservoir is a ring canal embraced by said lining and said support, if necessary sealed at a thread slit.

16. Ballooning action constraining ring according to claim 1, comprising several superposed rings possessing a common axis of rotation.

17. Ballooning action constraining ring according to claim 1, wherein at least the portion of lubricant absorbing raw material is formed in a helix shape or a spiral.

* * * * *